US005915422A

United States Patent [19]

Fagerholm

[11] Patent Number: 5,915,422

[45] Date of Patent: Jun. 29, 1999

[54] MACHINE CLOTHING HAVING A SEAM, AND SPIRAL FOR USE IN SUCH A SEAM

[75] Inventor: Lars Fagerholm, Sibbo, Finland

[73] Assignee: Albany Nordiskafilt AB, Halmstad, Sweden

[21] Appl. No.: 08/913,979

[22] PCT Filed: Mar. 25, 1996

[86] PCT No.: PCT/SE96/00380

§ 371 Date: Sep. 25, 1997

§ 102(e) Date: Sep. 25, 1997

[87] PCT Pub. No.: WO96/30589

PCT Pub. Date: Oct. 3, 1996

[30] Foreign Application Priority Data

Mar. 23, 1995 [SE] Sweden ..... 9501074

[51] Int. Cl.[6] ..... D21F 1/12; D21F 7/10; F16G 3/04

[52] U.S. Cl. ..... 139/383 AA; 428/58; 24/33 P

[58] Field of Search ..... 428/58; 24/33 C, 24/33 P, 33 A; 139/383 AA

[56] References Cited

U.S. PATENT DOCUMENTS 2,228,926 1/1941 Mattaei et al. ..... 24/33 P
4,827,579 5/1989 Gisbourne ..... 24/391
4,896,702 1/1990 Crook .
5,488,976 2/1996 Lorenz et al. ..... 139/383 AA

OTHER PUBLICATIONS

International Search Report. PCT/SE96/00380 Apr. 7, 1996.

*Primary Examiner*—Andy Falik
*Attorney, Agent, or Firm*—Kane, Dalsimer, Sullivan, Kurucz, Levy, Eisele and Richard, LLP

[57] ABSTRACT

An improvement (20) for producing an enhanced seam on a machine clothing for a paper or cellulose machine, especially, but not exclusively, when using flat filament yarns (26) in the machine direction of the clothing is shown. The seam has two preformed yarn spirals (20), which are each bound, by the machine direction yarns (26) of the clothing, to one seam edge, thereby each forming a row of seam loops (22) which are meshable with each other and joinable onto each other by means of a pintle wire. At least one spiral (20), preferably both, is, between neighboring seam loops (22) in the row of loops, preformed with special securing portions (24), to which the spiral (20) is attached at the corresponding seam edge. The securing portions (24) hold the seam loops (22) spaced apart and are extended substantially in the longitudinal direction of the spiral (20).

14 Claims, 6 Drawing Sheets

PRIOR ART
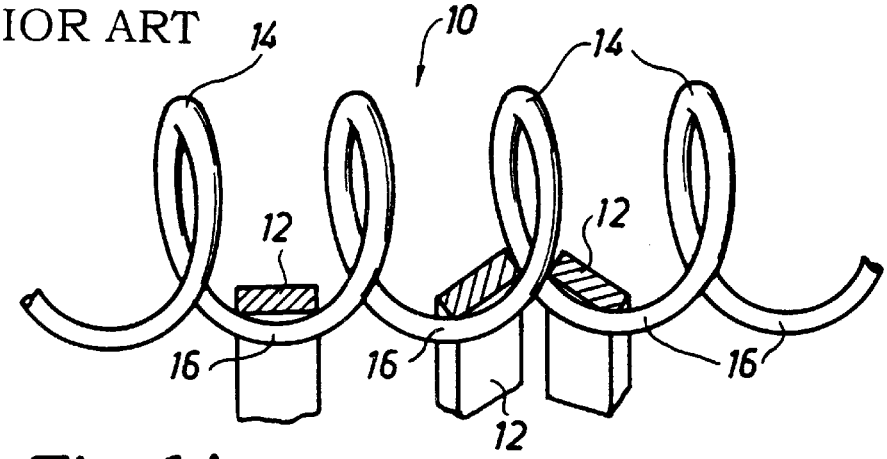
Fig. 1A
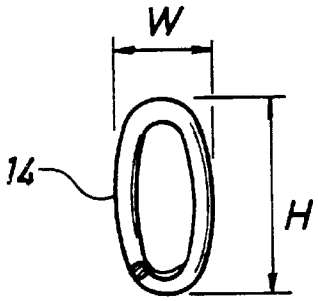
PRIOR ART
Fig. 1B
Fig. 3
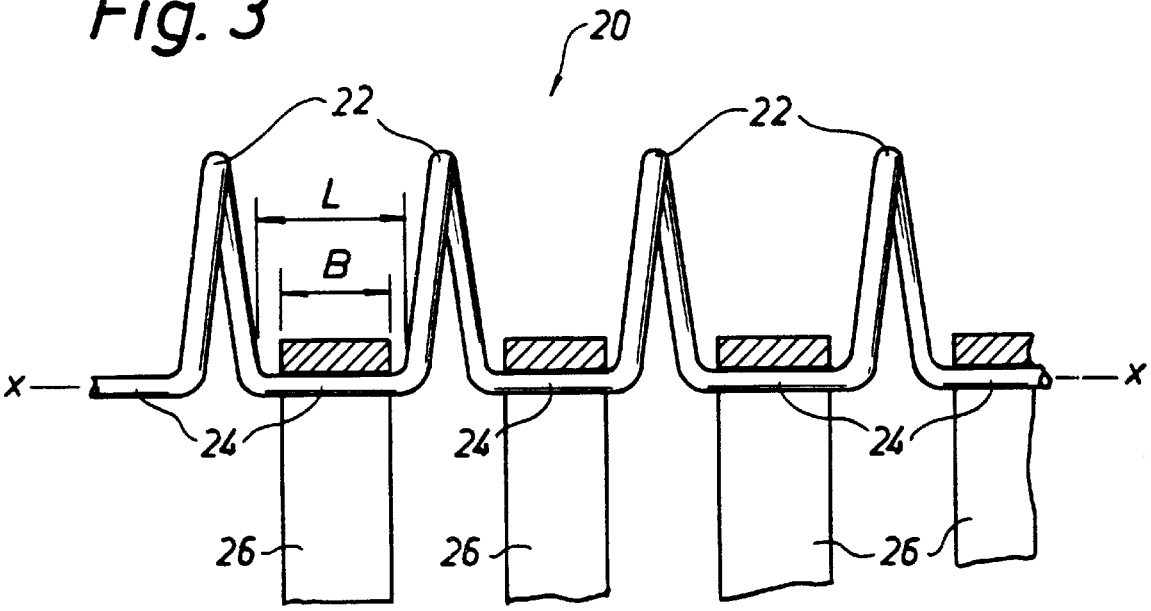

MACHINE CLOTHING HAVING A SEAM, AND SPIRAL FOR USE IN SUCH A SEAM

TECHNICAL FIELD OF THE INVENTION

The present invention relates to the technical field of seamed clothings for paper and cellulose machines. More specifically, the invention relates to an improved spiral for use in seams on clothings comprising flat filament yarns in the machine direction, i.e. in the running direction of the clothing in the machine. According to a first aspect, the invention relates to a machine clothing having such a seam and, according to a second aspect, a spiral for use in such a seam. The invention is especially applicable to the production of seams on dryer fabrics, but it may also be used for forming fabrics, press felts, filter cloths, belts etc, and is not exclusively usable for woven clothings.

BACKGROUND ART

It is known to use loop seams and spiral seams in openable clothings, such as dryer fabrics, for paper and cellulose machines, the opposite seam edges of the clothing each having a row of loops. When the clothing is to be installed in the machine, this is carried out with the seam being open, whereupon the seam edges are moved together and the seam loops of one row are meshed with the seam loops of the other row. Then the seam is joined by a so-called pintle wire being passed through the thus intermeshed rows of loops. The principle of such seamed clothings is described in more detail in an article by T. Branham in Tappi Journal (USA), June 1994, Vol. 77, No. 6, pp 285–288.

In a so-called warp loop seam, the rows of loops are formed of extended edge loops of warp yarns in the fabric structure of the clothing. In a so-called spiral seam, each row of loops is instead formed of a separate, preformed yarn spiral, which is extended along and attached by means of machine direction yarns, such as warp yarns, to the seam edge of the clothing. The yarn spiral is normally attached to the seam edge by being, after completion of the weaving, spliced into the seam edge by means of a special splicing machine. Alternatively, the spiral can be attached to the clothing by a number of cross-machine direction yarns being ravelled a distance from the seam edge, whereupon the loops of the spiral are inserted into the thus formed looser edge portion. Then the edge is folded back over itself and is attached to -he clothing, for instance, by using a sewing-machine. Independently of how the spiral is attached, the clothing comprises two spirals, one along each seam edge, which, when joining together the fabric, are meshed with each other like a zipper so as to be joined together by means of a pintle wire or the like.

Using such separate spirals is, in some cases, preferred to woven warp loops, since the shape of seam loops formed of a spiral is less dependent on the weaving technique.

A seam is generally a critical part of a seamed machine clothing, since a uniform paper quality, low marking and an excellent runnability of the clothing require a seam which is as similar as possible to the rest of the clothing in respect of properties such as thickness, structure, strength, permeability etc. These requirements are especially important in dryer fabrics in drying positions with suction rolls.

However, there are problems in prior-art spiral seams if the yarn spirals are bound to the seam edges by means of so-called flat filament yarns. In many cases, a dryer fabric is today woven of flat filament yarns, at least in its machine direction. By flat filament yarns are below meant yarns of non-circular cross-section. The cross-section of a flat filament yarn can be essentially rectangular, elliptic, an elongated polygon or combinations thereof. In general, the cross-section of the flat filament yarn has a great cross-sectional dimension and a small cross-sectional dimension. In the ready dryer fabric, the flat filament yarn extends with its great cross-sectional dimension substantially in parallel with the principal plane of the fabric.

Flat filament yarns are preferred to round yarns of circular cross-section, on the one hand because a flat filament yarn does not build up in the thickness direction to the same extent as a round yarn, i.e. it results in a thinner clothing and, on the other hand, since a flat filament yarn yields a better contact with the web that is to be dewatered. A further advantage of flat filament yarns is that the wear potential of the fabric increases. Thus, the fabric maintains its surface structure, which results in a reliable and stable operation.

The flat filament yarn thus extends with its great cross-sectional dimension in parallel with the principal plane of the fabric, but in the area in which the flat filament yarn, for securing the yarn spiral to the seam edge, passes between two neighboring spiral loops (seam loops) and turns the spiral yarn over so as to bind thereto, the flat filament yarn will, however, normally occupy a different, less favorable orientation, in which the great cross-sectional dimension of the flat filament yarn instead makes an angle with the principal plane of the fabric. The situation at the seam edge thus is that the elongate cross-section of the flat filament yarn "places itself on edge" adjacent the yarn spiral. As a result, the flat filament yarn projects in the same area too high up above the surface of the fabric, which may lead to web marks and/or yarn wear at the risk of yarn breakage. This unfavorable situation is schematically illustrated in FIG. 1A of the enclosed drawing, which shows how a rectangular cross-section of a flat filament yarn, which binds around a known yarn spiral, adapts poorly to the round "valley" of the spiral between two neighboring seam loops. In the two valleys to the right in FIG. 1A, the flat filament yarn has the above-mentioned unfavorable, inclined orientation.

It is also apparent from FIG. 1A that there is a further problem in the prior-art technique, illustrated by the warp yarn to the left in the Figure. This warp yarn has unsatisfactory contact with the yarn spiral, and therefore the binding points between the warp yarn and the spiral are not optimal. Owing to this unsatisfactory contact, the above-mentioned unfavorable displacement and turning of the warp yarns can arise more easily.

It will be appreciated that the above-mentioned problems will also be the more pronounced the wider the flat filament yarn selected.

The object of the present invention is to obviate the above problems and drawbacks of the prior-art technique.

Thus, the object of the invention is to ensure, in a machine clothing having a spiral seam, that optimum binding points are obtained between the clothing and the yarn spiral in the seam area, and that unfavorable incorrect orientation of the machine direction yarns in the seam area is prevented.

DISCLOSURE OF THE INVENTION

According to the invention, this object is achieved by a new and improved spiral structure, which yields optimum contact and binding to flat machine direction yarns in the seam area and which ensures that the machine direction yarns are correctly oriented in the seam area.

According to a first aspect of the invention, a machine clothing for a paper or cellulose machine is provided, comprising machine direction yarns and a spiral seam having two preformed yarn spirals each bound by the machine direction yarns to one seam edge of the clothing so as to form one row each of seam loops, which, for forming a seam, are meshable with each other and joinable onto each other by means of a pintle wire. The machine clothing is characterized in that at least one spiral, preferably both spirals, between neighboring seam loops in the row, is preformed with special securing portions, to which said spiral is attached at the corresponding seam edge, said securing portions holding the seam loops spaced apart and being extended substantially in the longitudinal direction of the spiral.

According to a second aspect of the invention, a preformed yarn spiral is provided, which is adapted to be secured along a seam edge on a paper or cellulose machine clothing to form a row of seam loops, which, for forming a seam on the clothing, are adapted to be fitted between seam loops of an opposite seam edge on said clothing and then be joined onto these by insertion of a pintle wire into the seam loops. The yarn spiral is characterized in that, between each pair of seam loops formed by the spiral, it is preformed with special securing portions for attaching the spiral to the seam edge, said securing portions holding the seam loops spaced apart and being extended substantially in the longitudinal direction of the spiral.

Preferred embodiments of the two above-mentioned aspects of the invention are as follows.

The special securing portions of the yarn spiral preferably are of a shape which fits the cross-section of the machine direction yarns of the clothing which bind to the securing portions, particularly when said machine direction yarns are flat filament yarns. Thus, the securing portions of the spiral can be substantially rectilinear if the spiral is attached to the seam edge by means of flat filament yarns of rectangular cross-section. If the flat filament yarns instead are elliptic, the securing portions can be slightly concave to fit the elliptic shape of the yarn. In the first-mentioned case, the transition between the securing portions of the spiral and the seam loops of the spiral can comprise relatively pronounced angles in the spiral yarn. In the second case having concave securing portions, a more uniform transition between the securing portions and seam loops of the spiral can be constructed.

However, the invention is applicable not only in combination with flat filament yarns, but also to machine direction yarns of, for instance, square cross-section.

The distance between neighboring seam loops of the spiral is determined by the length of the individual securing portions and is preferably adjusted to the great cross-sectional dimension of the flat filament yarn. The securing portions normally are of equal length, which results in a constant spacing between the seam loops. The length of the individual securing portions, i.e. the distance between the seam loops, normally is approximately equal to, alternatively somewhat greater than the corresponding dimension of the machine direction yarns binding the spiral to the seam edge, which in the case of flat filament yarns means that the length of the securing portions is approximately equal to or somewhat greater than the great cross-sectional dimension of the flat filament yarn. It would be advantageous to have the securing portions somewhat longer than the width of the yarn, since this makes it possible to reduce the wear between the yarn and the spiral loops.

As stated above, the securing portions of the spiral are, according to the invention, extended substantially in the longitudinal direction of the spiral. This means that each securing portion can be extended substantially quite in parallel with the seam edge or possibly be somewhat inclined relative to the seam edge, such that one end of the securing portion is closer to one principal surface of the clothing and the other end of the securing portion is closer to the opposite principal surface of the clothing. In any case, the securing portions of the spiral are directed substantially in parallel with the seam edge.

Furthermore, it would be preferred to have the securing portions of the spiral arranged successively in alignment with each other along the side of the spiral facing the seam edge. However, the possibility of the securing portions of the spiral instead being arranged at different distances and differently oriented relative to the seam edge is also within the scope of the invention.

The yarn portions of the yarn spiral which constitute the seam loops of the spiral can be formed of substantially entire spiral turns, the end points of the seam loops being located on essentially one and the same geometric line along the seam edge. Alternatively, the seam loops may be incomplete spiral turns (<360°). In this case, the end points of the seam loops will not be located on one and the same geometric line, and therefore the securing portions will be inclined correspondingly relative to the seam edge.

According to the invention, the preformed yarn spiral with the special securing portions thus has a non-constant pitch, both before and after the mounting of the spiral at the seam edge. More precisely, according to the invention most of the pitch of the spiral is normally located in the securing portions, while each seam loop is extended substantially perpendicular to the longitudinal direction of the spiral, i.e. at right angles to the seam edge. Each seam loop can, of course, be more or less compressed in the longitudinal direction of the spiral, and the degree of compression can be altered as the length (extent) of the spiral is changed during mounting thereof.

The spiral according to the invention can be attached to the clothing by using the per se known folding and splicing methods as described above. If splicing is used, some of the machine direction yarns at the seam edge can form so-called blank loops which do not bind around the spiral, as is known in this technical field.

The material and the thickness of the inventive spiral and the manufacture of the spiral are not part of the present invention. Most materials that are traditionally used for the manufacture of known spirals for spiral seams on machine clothings in paper and cellulose machines are usable also for the manufacture of spirals according to the invention, and the selection of material will depend on the type of clothing and the position of installation. However, use is generally made of some sort of polymeric material that can be preformed. The actual preforming of the spiral comes easy to an expert in this field. A yarn which is to form the spiral can, for instance, be wound round a suitably formed spear or horn to the desired shape, whereupon the shape of the thus formed spiral can be set by thermal treatment.

Within the scope of the invention, there is also the possibility of making the spiral by casting, extrusion etc. to a length corresponding to the entire or part of the length of the seam edge to which it should be attached.

Besides, it is within the scope of the invention to carry out the final setting of the shape of the spiral only in connection with the actual attachment to the seam edge.

It is also within the scope of the invention to use not only a single yarn material for the spiral, but instead a combination of several materials.

Other characteristics and variants of the invention will appear from the accompanying claims.

BRIEF DESCRIPTION OF THE DRAWINGS

The invention will now be described in more detail with reference to the accompanying drawings, in which FIG. 1A is a schematic view of part of a known spiral attached by means of flat filament yarns, FIG. 1B is a view of a seam loop of the spiral in FIG. 1A, FIG. 3 is a schematic side view of the spiral in FIG. 2.

DETAILED DESCRIPTION OF A PREFERRED EMBODIMENT

Figure 2:
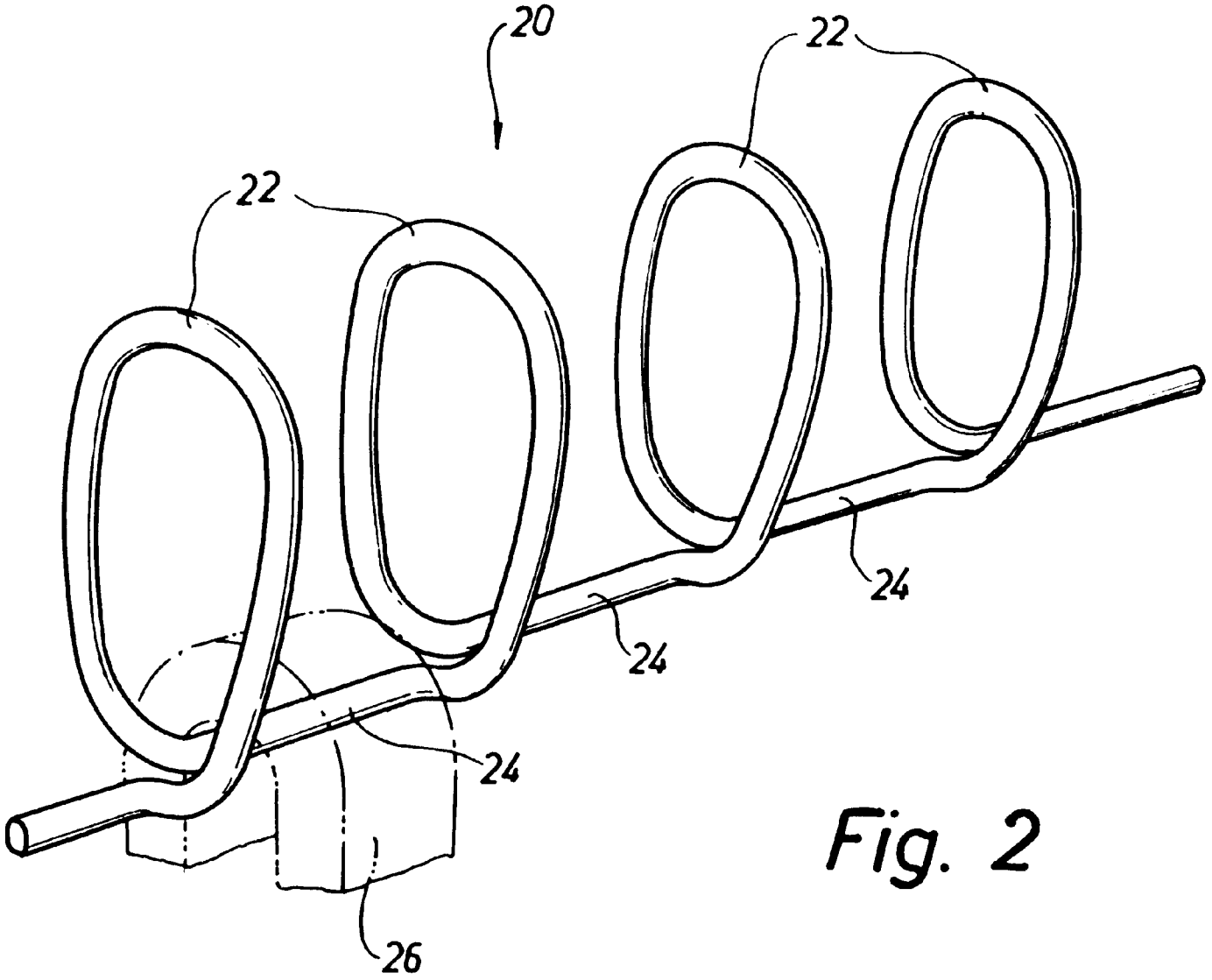
FIG. 2 is a schematic perspective view of part of a preferred embodiment of a spiral according to the invention attached by means of flat filament yarns.

FIG. 1A is a schematic view of a broken-away portion of a known symmetric spiral 10 for a spiral seam on, for instance, a woven dryer fabric having flat filament yarns 12 in its machine direction. The spiral 10 has a substantially constant pitch and forms a row of seam loops 14 connecting with each other in "valleys" 16, in which the flat filament yarns 12 bind around the spiral 10 in order to attach this to the seam edge of the dryer fabric.

FIG. 1B is a schematic view, seen in the longitudinal direction of the spiral 10, of such a seam loop 14, the height and width (thickness) of the loop being designated H and W, respectively. H is normally in the range 3.0–10.0 mm, and W is normally in the range 1.0–6.0 mm. Normally used flat filament yarns usually have a smallest cross-sectional dimension in the order of 0.15–0.40 mm, and a greatest cross-sectional dimension in the order of 0.50–1.20 mm.

As described by way of introduction, the known spiral 10 yields an unsatisfactory binding to the flat filament yarns 12, and owing to the poor fit in the valleys 16, the flat filament yarns 12 can easily occupy an incorrect orientation, as shown in the two right-hand valleys in FIG. 1A.

FIG. 2, which is a schematic perspective view of a broken-away portion of an embodiment of a spiral 20 according to the invention, illustrates how the inventive spiral 20 is preformed with seam loops 22 having the same function as the seam loops 14 of the known spiral 10 in FIG. 1, and special securing portions 24 which are arranged between the seam loops 22 to keep them spaced apart and which, in the shown embodiment, are substantially rectilinear and extended along a common geometric line X—X in parallel with the seam edge. This is best shown in FIG. 3.

Figure 6:
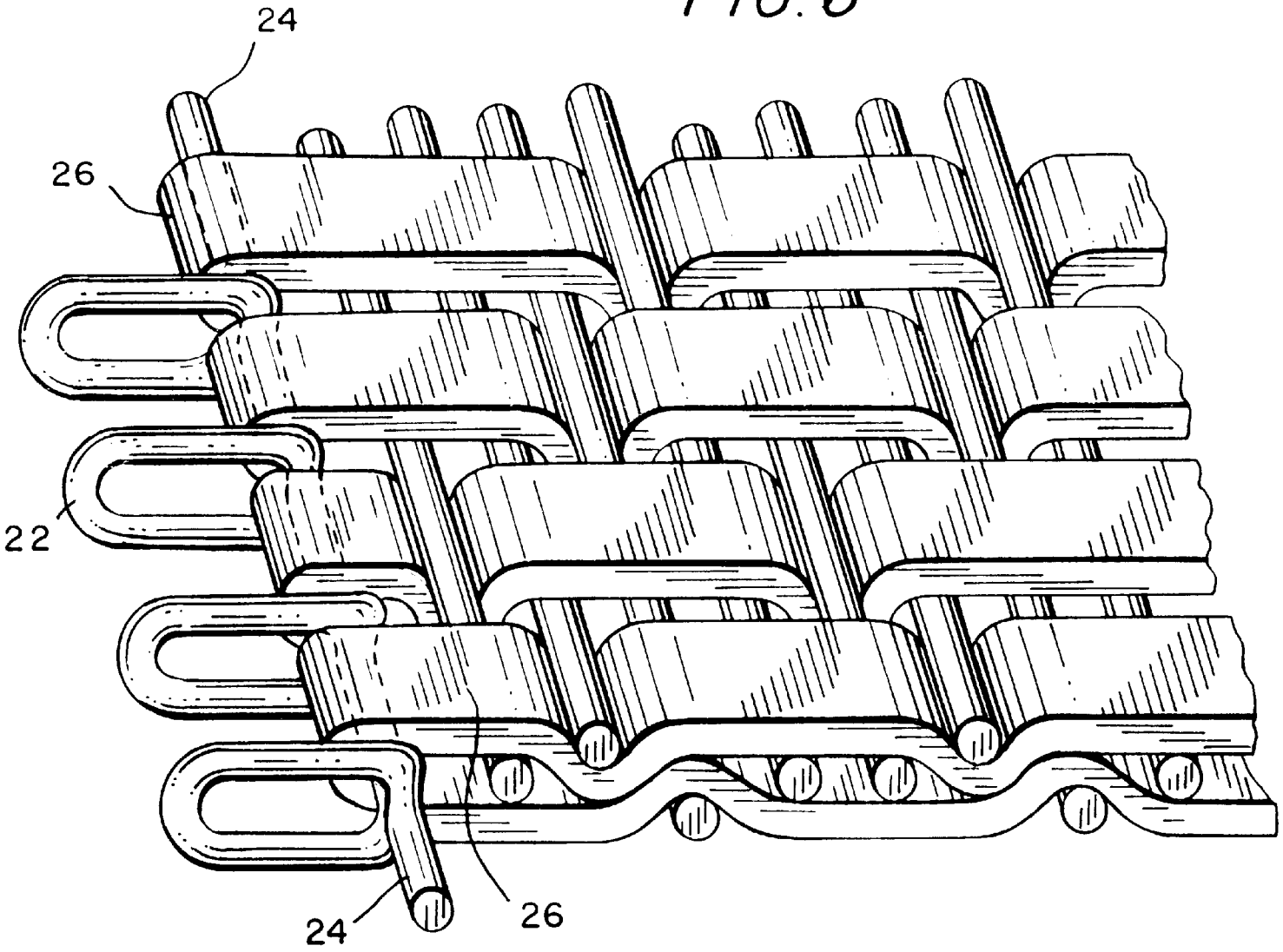
FIG. 6 is a perspective view like that of FIG. 5 showing securing portions extending parallel to the seam edge in phantom.

The spiral 20 is bound to a clothing, as shown in FIG. 6 comprising flat filament yarns 26 in its machine direction, which can be of the same material and have the same cross-sectional dimensions as today known flat filament yarns for dryer fabrics, for instance cross-sectional dimensions which are to be found in the ranges mentioned above. FIG. 3 shows that the flat filament yarns 26 bind around the securing portions 24 and abut against these with a good contact surface owing to the fact that the shape of the securing portions 24 is adapted to the shape of the flat filament yarns 26. It will thus be appreciated that the length L of the securing portions 24 should be adapted to the width B of the flat filament yarns and to the spacing between the flat filament yarns. To avoid wear-between the yarns 26 and the spiral in the transitions between the securing portions 24 and the seam loops 22, the length L can preferably be chosen to be somewhat greater than the width B.

Thus, the spiral 20 in FIGS. 2 and 3 yields an optimum contact with and binding to the warp yarns 26, and the length L of the straight securing portion 24 can be adjusted to fit any weave pattern and any warp yarn dimension.

Figure 4:
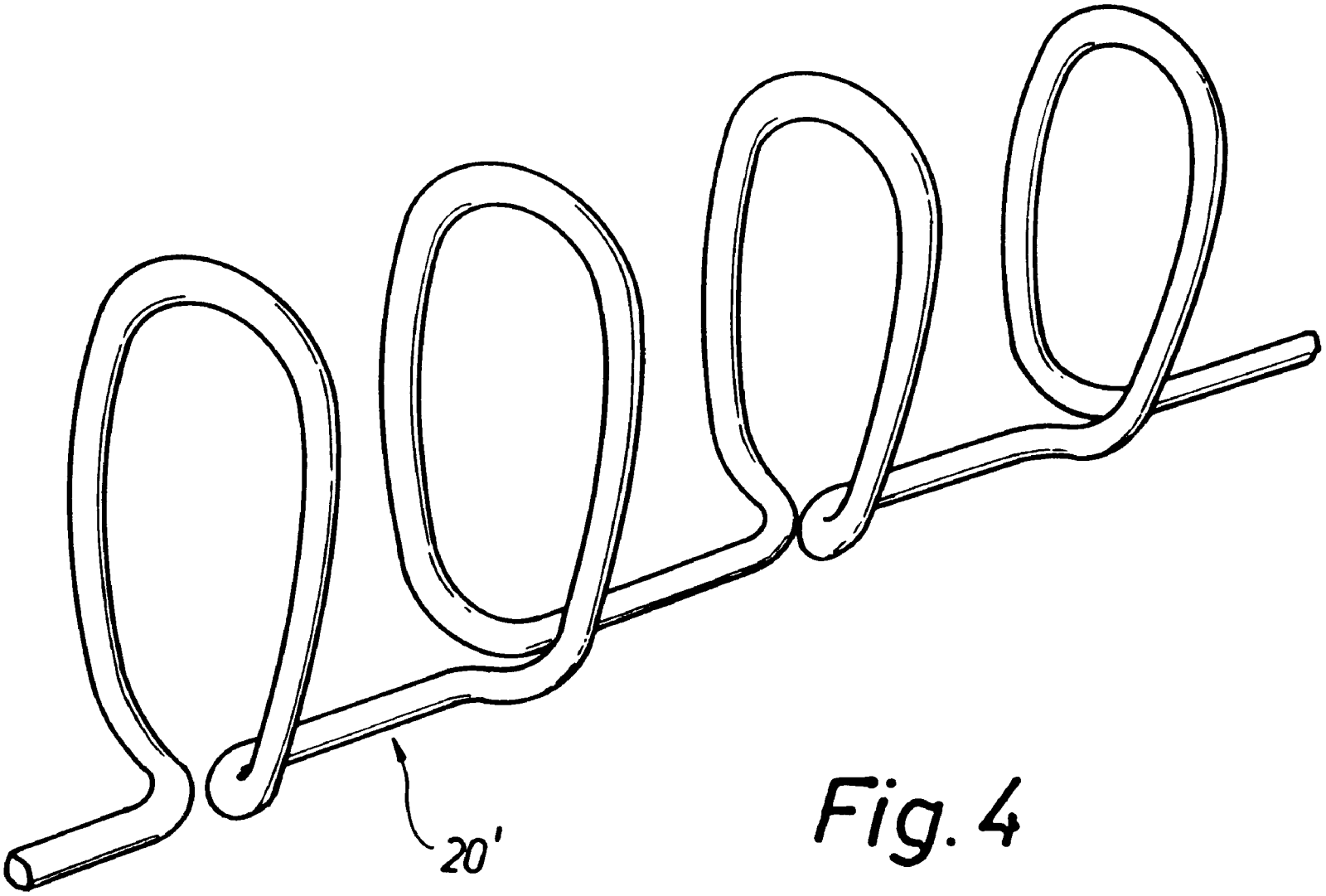
FIG. 4 is a schematic perspective view of part of an alternative embodiment of a spiral according to the invention.

FIG. 4 is a perspective view of a variant 20' of the spiral 20 in FIGS. 2 and 3. The spiral 20' differs by its seam loops being turned alternatingly clockwise and anti-clockwise, while the joining securing portions are positioned, like in the embodiment in FIGS. 2 and 3, substantially on a common straight geometric line. This embodiment may have the advantage that, in the manufacture of the spiral, use can be made of a reciprocating process, instead of a rotary process, thereby avoiding an undesired second spiralling of the yarn.

Within the scope of the invention and as shown by e.g. the embodiment in FIG. 4, the term "spiral" should thus be interpreted in a wider sense than is normally understood by this term. Particularly, the term "spiral" should comprise winding patterns according to the principle in FIG. 2, the direction of winding being uniform, and winding patterns according to the principle in FIG. 4, in which the winding direction alternates between each loop, as well as winding patterns which are a combination of the principles in FIGS. 2 and 4, i.e. a winding pattern in which the spiral, in its longitudinal direction, is divided into portions which within themselves have two or more loops of the same winding direction, but the loops of neighboring portions having the opposite direction of winding. Moreover, the term "spiral" should be considered to comprise spirals whose loops are already spaced apart before mounting, as well as spirals which are given the inventive shape only after an axial extension of the spiral.

Figure 5:
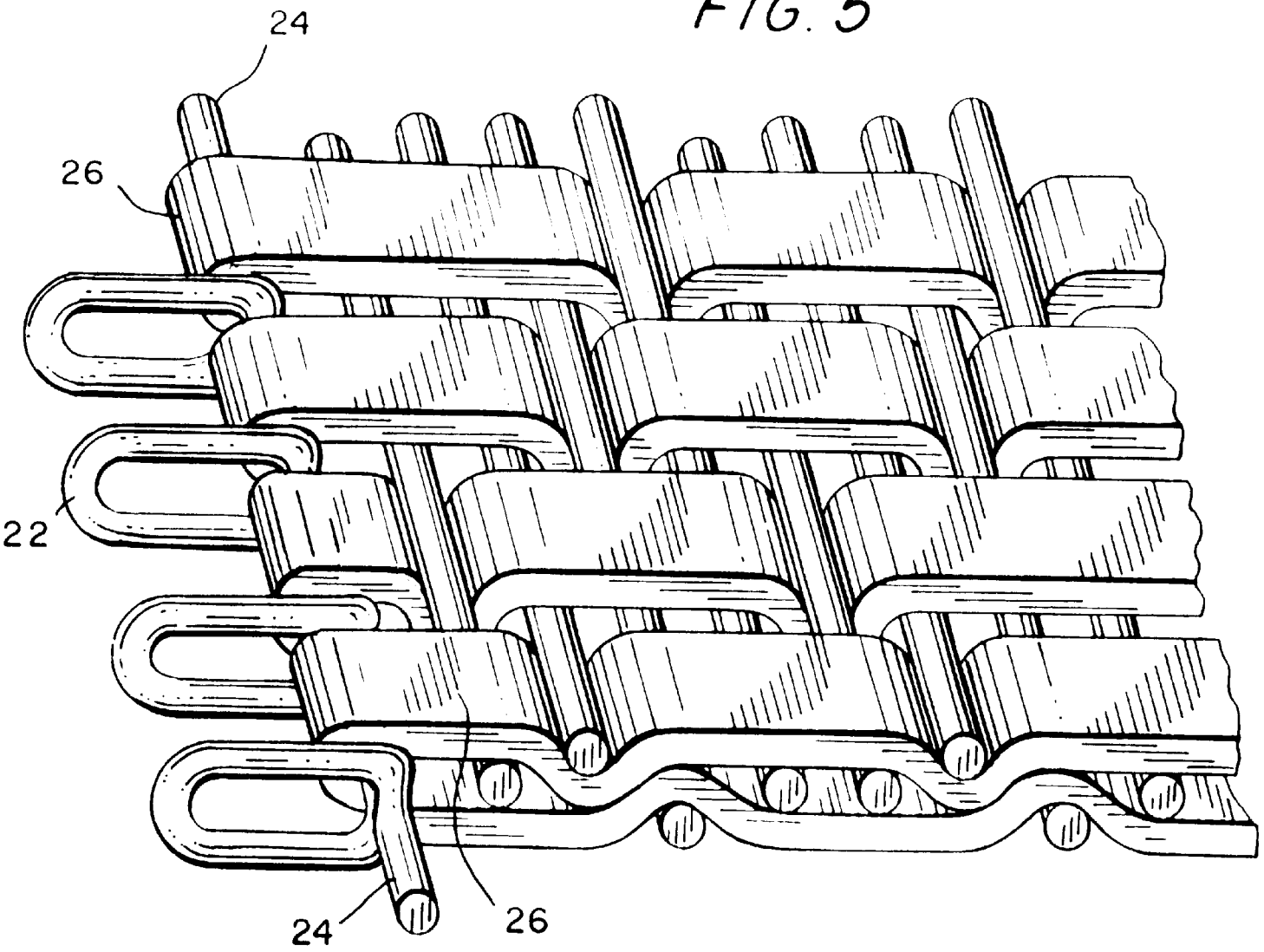
FIG. 5 is a perspective view of the end of a papermaker's clothing with the spiral attached.
Figure 7:
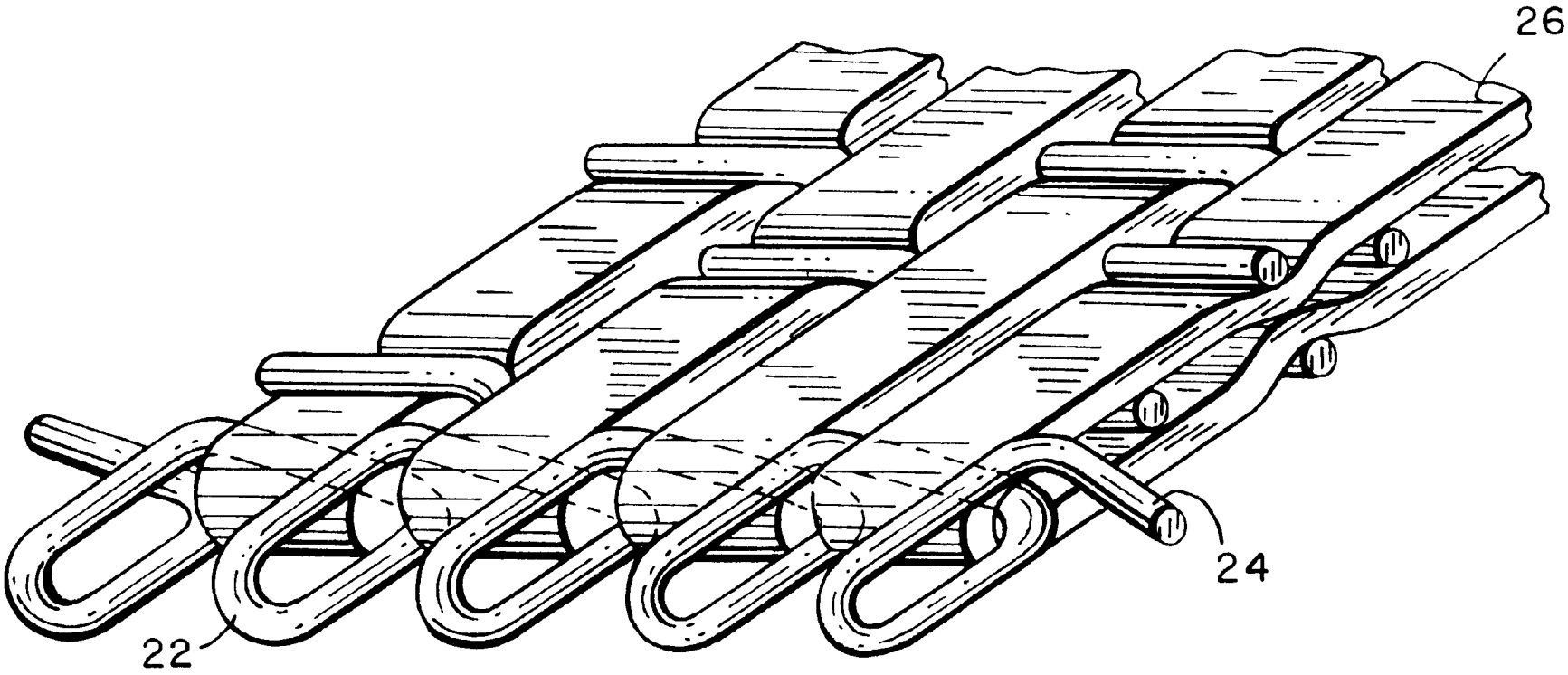
FIG. 7 is a perspective view like that of FIG. 6 showing securing portions inclined relative to the seam edge.

FIG. 6 is a perspective view like that of FIG. 5 showing securing portions 24 extending parallel to the seam edge in phantom, and FIG. 7 is a perspective view like that of FIG. 6 showing securing portions 24 inclined relative to the seam edge.

As previously noted, FIG. 5, a perspective view of the end of a papermaker's clothing with the spiral 20 attached, shows flat filament yarns 26 binding around the securing portions 24 of spiral 20. The length L of the securing portions 24 is adapted to the width of the flat filament yarns 26 and to the spacing between the flat filament yarns 26 where the seam loops 22 are located.

More specifically, FIGS. 6 and 7, like FIG. 5, are perspective views of the end of a papermaker's clothing with the spiral 20 attached. In both FIGS. 6 and 7, the securing portions 24 are shown in phantom (dashed) lines where they are blocked from view by flat filament yarns 26. In FIG. 6, the securing portions 24 extend substantially in the longitudinal direction of the spiral 20 and are therefore parallel to the seam edge. In FIG. 7, the securing portions 24 are inclined relative to the seam edge, such that one end of the securing portions 24 is closer to one surface of the clothing sand the other end of the securing portions is closer to the other surface of the clothing.

I claim:

1. A machine clothing for use as a dryer fabric or as a base fabric in a press felt for a paper or cellulose machine, said machine clothing comprising machine direction yarns (26), two fabric seam edges and a spiral seam having two preformed yarn spirals (20), said machine direction yarns (26) being flat filament yarns of a cross section having a small and a great (B) cross-sectional dimension, said great (B) cross-sectional dimension being parallel to a surface of the fabric, each of said spirals (20) being bound by the machine direction yarns (26) to one of said two fabric seam edges of the clothing so as to form a row of seam loops (22) along each fabric seam edge, which, for forming a seam, are meshable with each other and joinable onto each other by means of a pintle wire, wherein at least one of said spirals (20) has preformed securing portions (24) between neighboring seam loops (22), said spiral (20) being attached to said fabric seam edge at said securing portions (24), said securing portions (24) holding the seam loops (22) spaced apart and being extended substantially in the longitudinal direction (X—X) of the spiral (20).

2. The machine clothing as claimed in claim 1, wherein the securing yarn spiral (20) are substantially rectilinear.

3. The machine clothing as claimed in claim 1, wherein the flat filament yarn (26) is of substantially rectangular cross-section.

4. The machine clothing as claimed in claim 2, wherein each securing portion (24) of said spiral (20) is of a length (L) which is substantially equal to the great cross-sectional dimension (B) of the flat filament yarn (26).

5. The machine clothing as claimed in claim 2, wherein each securing portion (24) of the spiral (20) is of a length (L) which is slightly greater than the great cross-sectional dimension (B) of the flat filament yarn (26).

6. The machine clothing as claimed in claim 1, wherein each securing portion (24) is extended substantially parallel (X—X) with the seam edge.

7. The machine clothing as claimed in claim 1, wherein each securing portion (24) is slightly inclined relative to the seam edge.

8. The machine clothing as claimed in claim 1, wherein the securing portions (24) are arranged successively along a common geometric line (X—X) extending in parallel with and positioned adjacent the seam edge.

9. The machine clothing as claimed in claim 1, wherein it is a woven clothing.

10. The machine clothing as claimed in claim 1, wherein both of said spirals (20) have preformed securing portions (24).

11. In combination with the edge portions of a paper making fabric having flat machine-direction yarns, a preformed yarn spiral (20), which is adapted to be secured along one of said edge portions to form a row of seam loops (22), which, for forming a seam on said fabric, are adapted to be fitted between seam loops (22) of an opposite edge portion on said fabric and then be joined onto these by insertion of a pintle wire into the seam loops (22), wherein the spiral (20), between each pair of seam loops (22) formed by the spiral, is preformed with special securing portions (24) for attaching the spiral (20) to the edge portion, said securing portions (24) holding the seam loops (22) spaced apart and being extended substantially in the longitudinal direction (X—X) of the spiral (20), said securing portions being held to said edge portion of said fabric by said flat machine-direction yarns.

12. The preformed yarn spiral (20) as claimed in claim 11, wherein the securing portions (24) are substantially rectilinear.

13. The preformed yarn spiral (20) as claimed in claim 11, wherein the securing portions (24) are extended along a common geometric line (X—X) in parallel with the longitudinal direction of the spiral (20).

14. The preformed yarn spiral (20) as claimed in claim 11, wherein said preformed yarn spiral has a pitch, said pitch being the distance separating the seam loops (22) from one another, and wherein most of the pitch of spiral (20) is located in the securing portions (24).

* * * * *